US008684346B2

(12) United States Patent
Yamazaki et al.

(10) Patent No.: US 8,684,346 B2
(45) Date of Patent: Apr. 1, 2014

(54) SHEET FEEDING APPARATUS AND IMAGE FORMING APPARATUS

(75) Inventors: Yoshitaka Yamazaki, Abiko (JP); Yuzo Matsumoto, Abiko (JP); Tetsuro Fukusaka, Abiko (JP); Taishi Tomii, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/569,400

(22) Filed: Aug. 8, 2012

(65) Prior Publication Data

US 2013/0049286 A1 Feb. 28, 2013

(30) Foreign Application Priority Data

Aug. 24, 2011 (JP) ..... 2011-182340

(51) Int. Cl.
*B65H 3/14* (2006.01)

(52) U.S. Cl.
USPC ..... 271/97; 271/96; 271/104; 271/105

(58) Field of Classification Search
USPC ..... 271/90, 97, 98, 105, 167–169, 104
See application file for complete search history.

(56) References Cited

U.S. PATENT DOCUMENTS 5,135,213 A * 8/1992 Malachowski et al. ..... 271/104
7,490,826 B2 * 2/2009 Takai et al. ..... 271/98
7,540,489 B2 6/2009 Kushida
7,568,691 B2 8/2009 Matsumoto
7,591,459 B2 9/2009 Matsumoto et al.
7,823,875 B2 11/2010 Fukatsu et al.
7,841,591 B2 * 11/2010 Ueda et al. ..... 271/98
8,132,808 B2 * 3/2012 Ohfuchi ..... 271/152
8,167,296 B2 5/2012 Matsumoto
8,172,219 B2 5/2012 Matsumoto
8,210,519 B2 7/2012 Fukusaka et al.
8,262,080 B2 9/2012 Matsumoto et al.
8,272,634 B2 9/2012 Fukatsu et al.
2001/0017441 A1 * 8/2001 Yamaguchi et al. ..... 271/94
2008/0088078 A1 * 4/2008 Kushida ..... 271/90
2008/0290589 A1 * 11/2008 Uji et al. ..... 271/153
2009/0001646 A1 1/2009 Matsumoto
2010/0295237 A1 * 11/2010 Matsumoto ..... 271/11
2011/0169211 A1 * 7/2011 Matsumoto et al. ..... 271/5
2012/0049437 A1 3/2012 Matsumoto et al.

* cited by examiner

*Primary Examiner* — Jeremy R Severson
(74) *Attorney, Agent, or Firm* — Fitzpatrick, Cella, Harper & Scinto

(57) ABSTRACT

Provided is a sheet feeding apparatus capable of reliably feeding thin sheets in a separated state and an image forming apparatus including the same.

A floating preventing member which regulates an upward movement of an uppermost sheet floated by air is provided so as to be lifted and lowered between a tail end regulating plate regulating the position of the sheet above a tray and an adsorbing and conveying portion which conveys the uppermost sheet floated by the air blowing from a downstream air blowing portion. The adsorbing and conveying portion is moved to a predetermined regulating position higher than the height position of the uppermost sheet and lower than the feeding surface of the adsorbing and conveying portion before the sheet is floated, which suppresses the movement of the sheet toward the tail end side caused by the curling of the sheet due to the air.

18 Claims, 14 Drawing Sheets

SHEET FEEDING APPARATUS AND IMAGE FORMING APPARATUS

BACKGROUND OF THE INVENTION

1. Field of the Invention

The present invention relates to a sheet feeding apparatus and an image forming apparatus, and particularly, to a sheet feeding apparatus capable of conveying sheets in a separated state by blowing air to the sheets and an image forming apparatus including the same.

2. Description of the Related Art

Hitherto, an image forming apparatus such as a printer and a copying machine includes a sheet feeding apparatus which feeds sheets one by one from a sheet accommodating portion that accommodates a plurality of sheets. As the sheet feeding apparatus, there is known an air feeding type sheet feeding apparatus which blows air to an upper portion of a sheet bundle stacked on a tray so as to feed the sheets in a sorted state or in a floated state while being adsorbed onto an adsorbing and conveying belt disposed above the sheet.

The sheet feeding apparatus includes a tail end regulating member which regulates the tail end of the sheet bundle stacked on the tray and a tail end pressing member which is provided in the tail end regulating member so as to be movable in the vertical direction. The tail end pressing member is used to press the tail end portion of the sheet by a certain force, of which the tail end position is regulated by the tail end regulating member while being floated by the blown air, from the upper side of the sheet.

Here, since the tail end pressing member is provided, even when the uppermost sheet is floated by the air blowing from a leading end separating duct which is positioned at the sheet front end side, the tail end portion of the sheet may be pressed by the tail end pressing member from the upper side of the sheet. As a result, only the center portion of the uppermost sheet in the width direction is separated from a second sheet, and for example, when the separated uppermost sheet is adsorbed onto the adsorbing and conveying belt by a negative pressure, a gap is formed between the uppermost sheet and the second sheet so that the gap is blocked by the tail end portions of the sheets.

Then, since the gap is formed, air which flows along the gap flows throughout the entire area between the uppermost sheet and the second sheet. As a result, the uppermost sheet and the second sheet may be effectively separated from the leading ends of the sheet to the tail end thereof, which improves the sheet separating performance (see U.S. Patent Application Publication No. 2008/0088078 A1).

Incidentally, in the sheet feeding apparatus of the related art, when sorting air blows from the leading end of the sheet, the sheet is pressed toward the downstream side in the blowing direction, but the tail end portion is regulated by the tail end regulating plate and is pressed by the tail end pressing member from the upper side of the sheet. For this reason, when the sorting air blows from a leading end of a sheet having a small stiffness (stiffness degree), for example, a thin sheet called an ultrathin sheet having a basis weight of 50 $g/m^2$ or less, the sheet is floated and the leading end is pressed so as to be deviated backward.

This is because the center portion of the sheet rises when the leading end of the sheet is pressed by air while the tail end is regulated due to the small stiffness of the sheet. The state is illustrated in FIG. 14. Sheets S which are stacked on a tray 12 are regulated by a tail end pressing member 17 which is provided in a tail end regulating plate 13. When sorting air and separating air blow in the directions C and D by an air blowing portion 152 to the leading ends of the sheets S stacked on the tray 12, the center portion of the floating upper sheet rises due to the small stiffness of the sheet.

Here, when the center portion rises in this way, the upper sheet is deviated backward. At this time, when the backward deviation amount of the next sheet Sb of the uppermost sheet Sa is smaller than that of the uppermost sheet Sa, the leading end of the next sheet Sb is exposed to the adsorbing portion of the adsorbing and conveying belt 21. When the adsorbing and conveying belt 21 adsorbs and conveys the sheet in this state, the adsorbing and conveying belt 21 also adsorbs the next sheet Sb together with the uppermost sheet Sa, which causes double-feeding of the sheet.

Then, when the double-feeding of the sheet occurs, a feeding failure such as skew-feeding or curling occurs on the sheet. Also, when the double-fed sheets are sent to the image forming portion, a defective image occurs. That is, when air blows to particularly thin sheets so as to feed the sheets in a separated state, there is a concern that the sheets may not be reliably fed in a separated state. Furthermore, such drawbacks also occur in a sheet feeding apparatus which sorts sheets by blowing air to a sheet bundle from the side portion thereof and feeds the sheet by a feeding roller.

Therefore, the invention is made in view of such circumstances, and provides a sheet feeding apparatus capable of feeding even thin sheets in a separated state and an image forming apparatus including the same.

SUMMARY OF THE INVENTION

According to the present invention, there is provided a sheet feeding apparatus including a tray that supports sheets thereon and is able to be lifted and lowered, an air blowing portion provided on a downstream of the tray in a sheet feeding direction that blows air from downstream end portions of the sheets supported on the tray, and a sheet feeding portion that conveys an uppermost sheet of the sheets, supported on the tray, to which air blows. In the sheet feeding apparatus, a tail end regulating portion that comes into contact with upstream end portions of the sheets supported on the tray in the sheet feeding direction so as to regulate the positions of the sheets, a rising regulating portion that is installed above the tray so as to be able to be lifted and lowered between the tail end regulating portion and the sheet feeding portion and regulates upward rising of the uppermost sheet, a lifting and lowering portion that lifts and lowers the rising regulating portion, and a controller that controls the lifting and lowering portion and moves the rising regulating portion to a predetermined regulating position higher than the height position of the uppermost sheet and lower than a feeding surface of the sheet feeding portion before the air blowing from the air blowing portion.

According to the aspect of the invention, the rising regulating member which moves to a predetermined regulating position higher than the height position of the uppermost sheet and lower than the feeding conveying surface of the feeding portion suppresses the movement of the sheet toward the tail end side which is caused by the curling of the sheet due to the blowing air. Accordingly, even the thin sheets may be reliably fed in a separated state.

Further features of the present invention will become apparent from the following description of exemplary embodiments with reference to the attached drawings.

DESCRIPTION OF THE EMBODIMENTS

Figure 1:
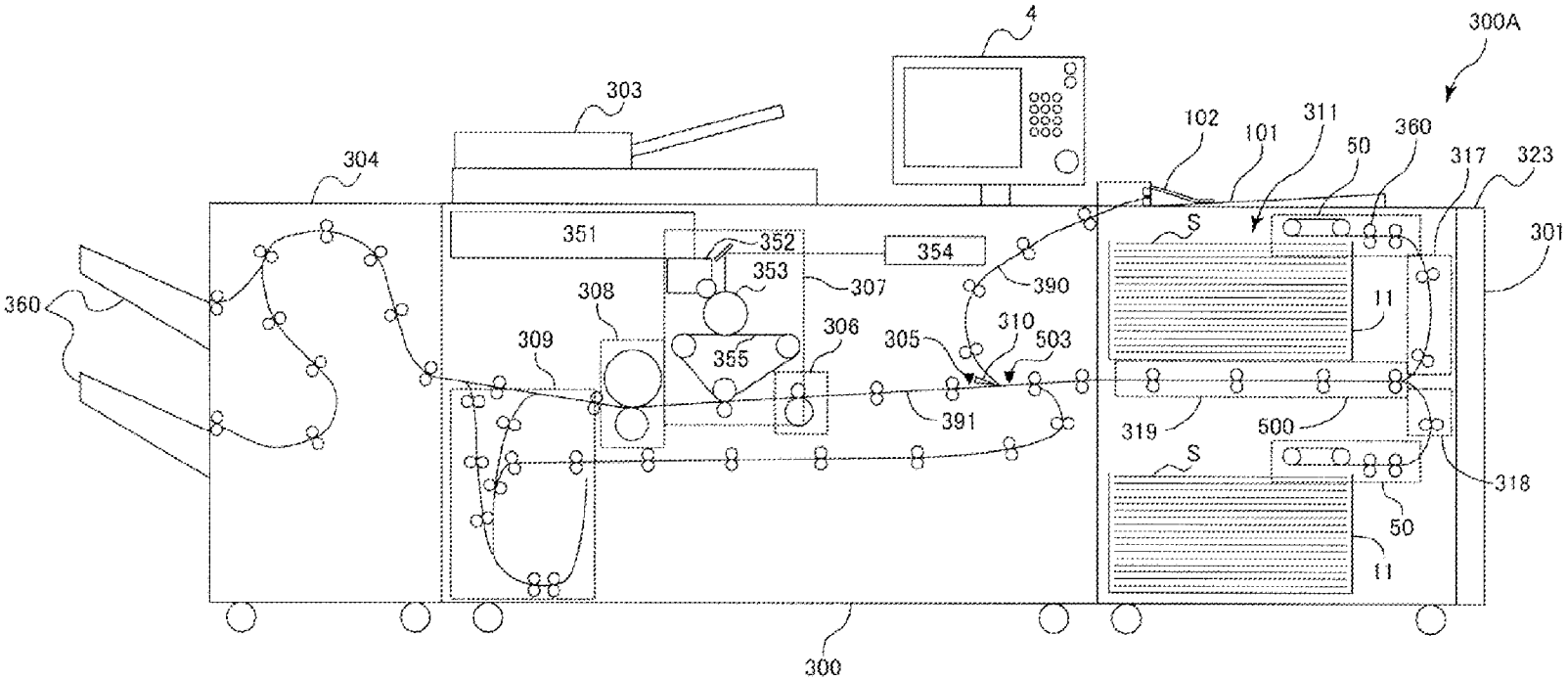
FIG. 1 is a diagram illustrating a schematic configuration of an image forming apparatus which includes a sheet feeding apparatus according to a first embodiment of the invention.

Hereinafter, exemplary embodiments of the invention will be described in detail by referring to the drawings. FIG. 1 is a schematic configuration diagram illustrating an image forming apparatus that includes a sheet feeding apparatus according to a first embodiment of the invention. In FIG. 1, an image forming apparatus 300A is provided, and the image forming apparatus 300A includes an image forming apparatus body (hereinafter, referred to as an apparatus body) 300, a sheet feeding unit 301, and a sheet processing apparatus 304. Then, various processes such as a sheet feeding and conveying operation, an image forming operation, and a stapling operation are performed based on a sheet process setting set by a user through an operation portion 4 or an external host PC (not illustrated) and image information transmitted from a reader portion 303 or the external host PC.

The sheet feeding unit 301 includes a sheet feeding apparatus 311 which is disposed in the vertical direction. The sheet feeding apparatus 311 is provided with a sheet storage case 11 which is a sheet accommodating portion accommodating a sheet bundle and an adsorbing and conveying portion 50 which is a sheet feeding portion feeding the sheets accommodated in the sheet storage case 11. Here, in the embodiment, the adsorbing and conveying portion 50 is of an air feeding type, and feeds the sheet while adsorbing the sheet on an endless belt during a sheet feeding operation.

Here, the sheet feeding unit 301 sequentially conveys the sheets of the respective sheet storage cases 11 in accordance with the sheet request information transmitted from the apparatus body 300, and notifies the completion of the sheet preparation to the apparatus body 300 after the sheet preparation is completed. The apparatus body 300 receives the completion of the sheet preparation from the sheet feeding unit 301, and notifies a delivery request. In accordance with each notification of the delivery request, the sheet feeding unit 301 sequentially feeds the sheets one by one in a separated state to the apparatus body 300, ends the sheet feeding operation after the sheets are fed by the number of required sheets, and becomes a standby state.

Furthermore, the sheet which is conveyed by the adsorbing and conveying portion 50 of the upper sheet feeding apparatus 311 is fed to the apparatus body 300 through an upper conveying portion 317 and a merging and conveying portion 319. Further, the sheet which is conveyed by the adsorbing and conveying portion 50 of the lower sheet feeding apparatus 311 is fed to the apparatus body 300 through a lower conveying portion 318 and the merging and conveying portion 319. Furthermore, the respective conveying portions 317 to 319 are provided with conveying stepping motors (not illustrated), and these motors are controlled so as to rotate the conveying rollers of the respective portions, thereby feeding the sheets.

The upper surface of the sheet feeding unit 301 is provided with an escape tray 101 which compulsorily discharges an abnormal sheet caused by double-feeding or jamming. A full loaded state detecting sensor 102 is provided so as to detect a full loaded state of the sheets discharged to the escape tray 101. Further, the respective conveying paths of the sheet feeding units 301 are provided with a plurality of conveying sensors (not illustrated), and the conveying sensors detect whether the sheets pass along the respective conveying paths.

The apparatus body 300 is used to form an image on the sheet fed by the sheet feeding unit 301, the upper surface thereof is provided with the operation portion 4 through which the user sets an operation setting mode, and the upper portion thereof is provided with the reader portion 303 which reads out an original image. Further, the apparatus body 300 includes an image creating portion 307 which is an image forming portion including a photosensitive drum 353, a laser scanner unit 354, a developing portion 352, an intermediate transfer belt 355, and the like, a fixing portion 308, a reverse conveying portion 309, and the like.

Then, the apparatus body 300 receives the sheet from the sheet feeding unit 301, and performs a sheet conveying operation by controlling the respective conveying portions provided in a conveying path 391 which guides the sheet to the image creating portion 307. Then, an image forming operation is performed based on the image data received in the image creating portion 307 at the time point when the sheet is detected in an image reference sensor 305. Furthermore, when a jam sensor 503 detects the abnormal sheet, a switching member 310 is switched so as to guide the sheet to an escape path 390 in front of the image creating portion 307 and to discharge the abnormal sheet to the escape tray 101 as a discharge portion.

Here, when the image reference sensor 305 detects the sheet during the image forming operation, a semiconductor laser (not illustrated) constituting the laser scanner unit 354 is turned on and the light quantity thereof is controlled. At the same time, a scanner motor which rotationally controls a polygon mirror (not illustrated) is controlled. Accordingly, the laser beam based on the image data is irradiated to the photosensitive drum 353, and a latent image is formed on the photosensitive drum 353.

Next, in the developing portion 352, the latent image on the photosensitive drum 353 is developed by feeding a toner from a toner bottle 351 thereto, and the developed toner image is primarily transferred to the intermediate transfer belt 355. Subsequently, by secondarily transferring the toner image transferred onto the intermediate transfer belt 355 to the sheet, a toner image is formed on the sheet. Furthermore, a register controller 306 is provided at a position directly before the secondary transfer position. Then, by using the register controller 306, the correction of the skew-feeding of the sheet or the sheet conveying control of minutely adjusting the toner image formed on the intermediate transfer belt 355 and the sheet leading end position so as to match them each other is performed on the sheet at a position directly before the transfer position without stopping the sheet.

Next, the secondarily transferred sheet is conveyed to the fixing portion 308, the toner is melted by the application of a heat and a pressure to the sheet in the fixing portion 308, and hence the toner is fixed onto the sheet. Furthermore, in a case where an image is printed (formed) on the rear surface of the fixed sheet or the front and rear surfaces of the sheet are reversed, the fixed sheet is conveyed to the reverse conveying portion 309. In a case where the printing operation ends, the fixed sheet is conveyed to the sheet processing apparatus 304 at the downstream side. Then, the sheet processing apparatus 304 performs a desired process (folding, stapling, and perforating) set by the user in the operation portion 4 on the sheet which is discharged from the apparatus body 300 and has an image formed thereon, and sequentially outputs the sheets as a result to a discharge tray 360.

Figure 2:
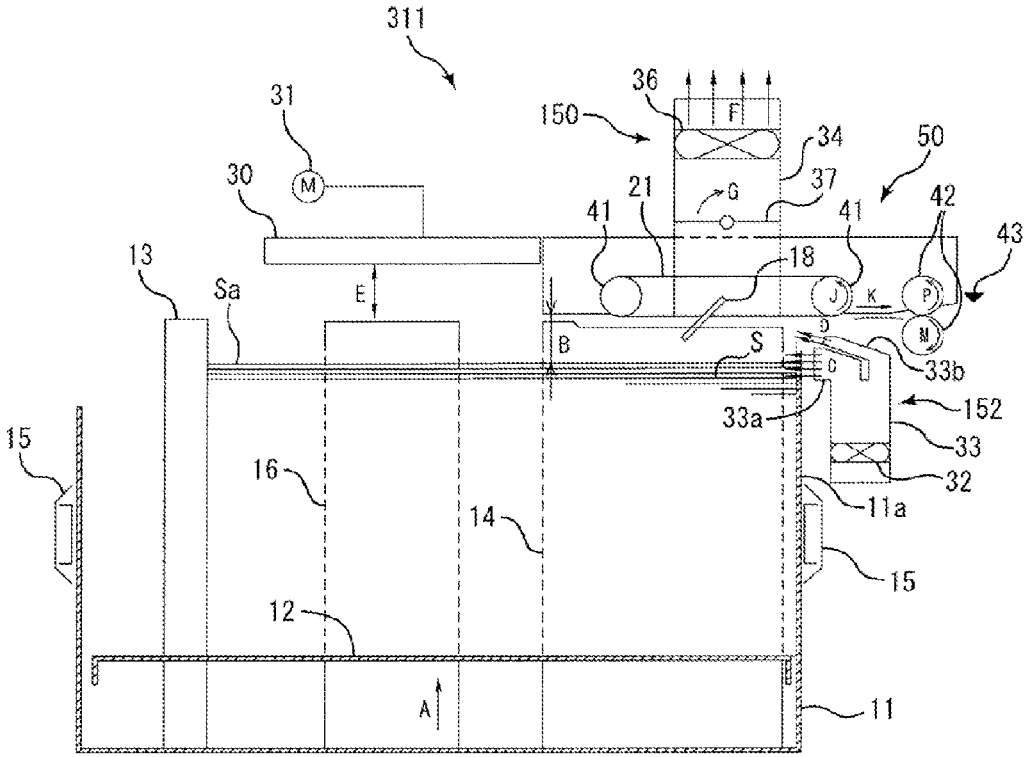
FIG. 2 is a cross-sectional view illustrating a configuration of the sheet feeding apparatus.

FIG. 2 is a diagram illustrating a configuration of the sheet feeding apparatus 311 which is provided in the sheet feeding unit 301. The sheet storage case 11 includes a tray 12 which places the plurality of sheets S thereon in a supported state and is able to be lifted and lowered and a tail end regulating plate 13 which constitutes a tail end regulating portion coming into contact with the tail end of the sheet as the upstream end in the sheet feeding direction and regulating the tail end position. The sheet storage case 11 further includes a leading end regulating plate 11*a* which regulates the leading end of the sheet as the downstream end in the sheet feeding direction and side end regulating plates 14 and 16 which regulate the position of the sheet S in the width direction as a direction perpendicular to the sheet feeding direction.

Furthermore, a slide rail 15 is provided so as to guide the sheet storage case 11 when the sheet storage case is drawn out, and the sheet storage case 11 may be drawn out from the sheet feeding unit 301 by the slide rail 15. Then, the sheet may be supplemented or replaced by lowering the tray 12 to a predetermined position when the sheet storage case 11 is drawn out from the sheet feeding unit 301.

Further, on the upper portion of the sheet storage case 11, an air feeding type sheet feeding mechanism (hereinafter, referred to as an air feeding mechanism) 150 is disposed so as to feed the sheets one by one in a separated state. The air feeding mechanism 150 includes an adsorbing and conveying portion 50 which adsorbs and conveys the sheets S stacked on the tray 12 and a downstream air blowing portion 152 which sorts the sheets by floating the upper portion of the sheet bundle on the tray and separates the sheets S one by one.

Here, the adsorbing and conveying portion 50 includes an adsorbing and conveying belt 21 which is suspended on belt driving rollers 41 and adsorbs and conveys the sheet S in the horizontal direction in the drawing and a suctioning fan 36 which generates a negative pressure used to adsorb the sheet S onto the adsorbing and conveying belt 21. Further, the adsorbing and conveying portion 50 includes a suctioning duct 34 which is disposed inside the adsorbing and conveying belt 21 and suctions air through a suctioning hole (not illustrated) formed in the adsorbing and conveying belt 21. In addition, the adsorbing and conveying portion 50 includes a suctioning shutter 37 which is disposed inside the suctioning duct 34 and enables or disables the adsorbing operation of the adsorbing and conveying belt 21.

Further, the downstream air blowing portion 152 includes a sorting nozzle 33*a* and a separating nozzle 33*b* which blows air from leading ends to the upper portion of the sheet bundle, a sorting fan 32, and a separating duct 33 which sends air from the sorting fan 32 to the respective nozzles 33*a* and 33*b*. Then, the air which is suctioned by the sorting fan 32 passes through the separating duct 33, and is blown in the direction indicated by the arrow C by the sorting nozzle 33*a* so as to float several sheets of the upper portion of the sheets S stacked on the tray 12. Further, the air which is suctioned by the sorting fan 32 is blown in the direction indicated by the arrow D by the separating nozzle 33*b*, and separates the uppermost sheet Sa floated by the sorting nozzle 33*a* so as to adsorb the uppermost sheet Sa onto the adsorbing and conveying belt 21.

Furthermore, a sheet surface detecting sensor 18 is a sheet detector which detects the sheet surface height position when the sheet is floated by the sorting fan 32 and detects that the sheet reaches a position where the sheet may be fed. The sheet surface detecting sensor 18 has three detection levels, and the sheet surface height increases as the level advances from a first level to a third level. Here, in the embodiment, the sheet surface detecting sensor 18 includes, for example, two detectors (not illustrated), and detects the sheet surface height position by the combination of the on and off states of two detectors.

Then, the case where the sheet surface detection is performed at the second level indicates that the sheet surface height of the floated sheet is at a position where the sheet may be appropriately adsorbed by the adsorbing and conveying belt 21. Thus, in a case where the sheet surface detecting sensor 18 performs the sheet surface detection at the first level, the tray 12 needs to be controlled so that it is lifted. In a case where the sheet surface detecting sensor 18 performs the sheet surface detection at the third level, the tray 12 needs to be controlled so that it is lowered. Then, when the tray 12 is lifted and lowered in response to the detection level of the sheet surface detecting sensor 18 and the detection level of the sheet surface detecting sensor 18 becomes the second level, it may be determined that the sheet surface of the uppermost sheet Sa reaches an appropriate height position.

Next, the sheet feeding operation of the sheet feeding apparatus 311 (air feeding mechanism 150) with such a configuration will be described. First, when the user extracts the sheet storage case 11, sets the sheets S therein, and accommodates the sheet storage case 11, the tray 12 starts to be lifted in the direction indicated by the arrow A illustrated in FIG. 2 by a lifter motor 19 illustrated in FIG. 4 to be described later. Then, when the distance between the sheet surface of the uppermost sheet Sa and the adsorbing and conveying belt 21 reaches a feeding enabled position B, a CPU 1 illustrated in FIG. 4 to be described later stops the tray 12 at that position, and then prepares a sheet feeding signal that starts a feeding operation.

Next, when the sheet feeding signal is detected, the CPU 1 operates the sorting fan 32 so that air is blown by the sorting nozzle 33*a* and the separating nozzle 33*b* in the respective directions C and D, that is, a direction from the downstream end of the sheet bundle in the sheet feeding direction toward the upstream in the sheet feeding direction. Accordingly, several upper sheets of the sheet bundle are blown up. Further, the CPU 1 operates the suctioning fan 36, so that air starts to blow in the direction indicated by the arrow F. At this time, since the suctioning shutter 37 is still closed, the uppermost sheet Sa is not adsorbed onto the adsorbing and conveying belt 21.

Next, when several upper sheets are stably floated after a predetermined time elapses from the detection of the sheet feeding signal, the CPU 1 drives an suctioning solenoid 38 to be described later so as to rotate the suctioning shutter 37 in the direction indicated by the arrow G. Accordingly, air is suctioned from the suctioning hole provided in the adsorbing and conveying belt 21, thereby generating an adsorbing force. Then, the uppermost sheet Sa is adsorbed onto the adsorbing and conveying belt 21 by the adsorbing force and the separating air from the separating nozzle 33*b*.

Subsequently, the CPU 1 drives a feeding motor 44 illustrated in FIG. 4 to be described later so as to rotate a belt driving roller 41 in the direction indicated by the arrow J. Accordingly, the uppermost sheet Sa is fed in the direction indicated by the arrow K while being adsorbed onto the adsorbing and conveying belt 21, and then is sent toward the image forming portion by a pair of drawing rollers 42 rotating in the directions indicated by the arrows P and M. Furthermore, a pass sensor 43 is provided at the downstream side of the pair of drawing rollers 42, and the CPU 1 monitors the passage of the sheet Sa through the pass sensor 43.

Figure 14:
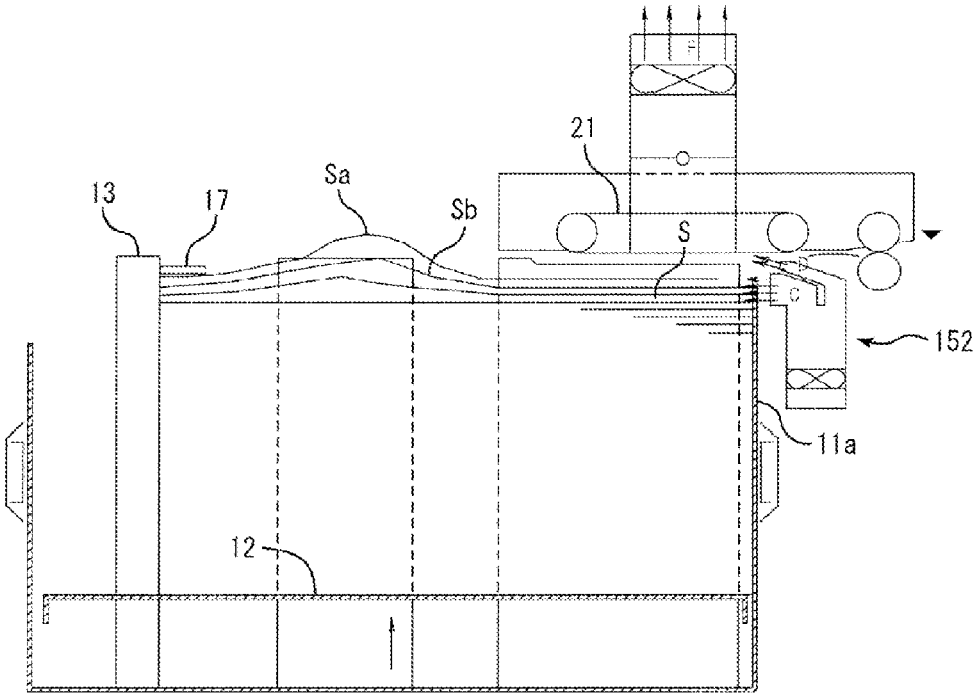
FIG. 14 PRIOR ART
FIG. 14 is a diagram illustrating a problem of a sheet feeding apparatus of the related art.

Incidentally, in some cases, a sheet called an ultrathin sheet may be fed of which the length in the sheet feeding direction is long, the basis weight is 50 g/m$^2$ or less, and the stiffness is small. In a case where such a sheet is fed, as illustrated in FIG. 14, the leading end of the uppermost sheet Sa is pressed to the downstream side in the blowing direction by the sorting air so that the center portion rises and the leading end is deviated backward from the leading end regulating plate 11*a* due to the low stiffness of the sheet.

Therefore, in the embodiment, a floating preventing member 30 which constitutes a rising regulating portion regulating the upper rising portion of the uppermost sheet is disposed in parallel to the sheet surface from the upstream end surface of the adsorbing and conveying portion 50 in the sheet feeding direction to the downstream end surface of the tail end regulating plate 13. Furthermore, the length of the floating preventing member 30 in the sheet main scanning direction is set to the minimum length of the sheet to be conveyed, and is a length corresponding to A5R in the embodiment.

Figure 3:
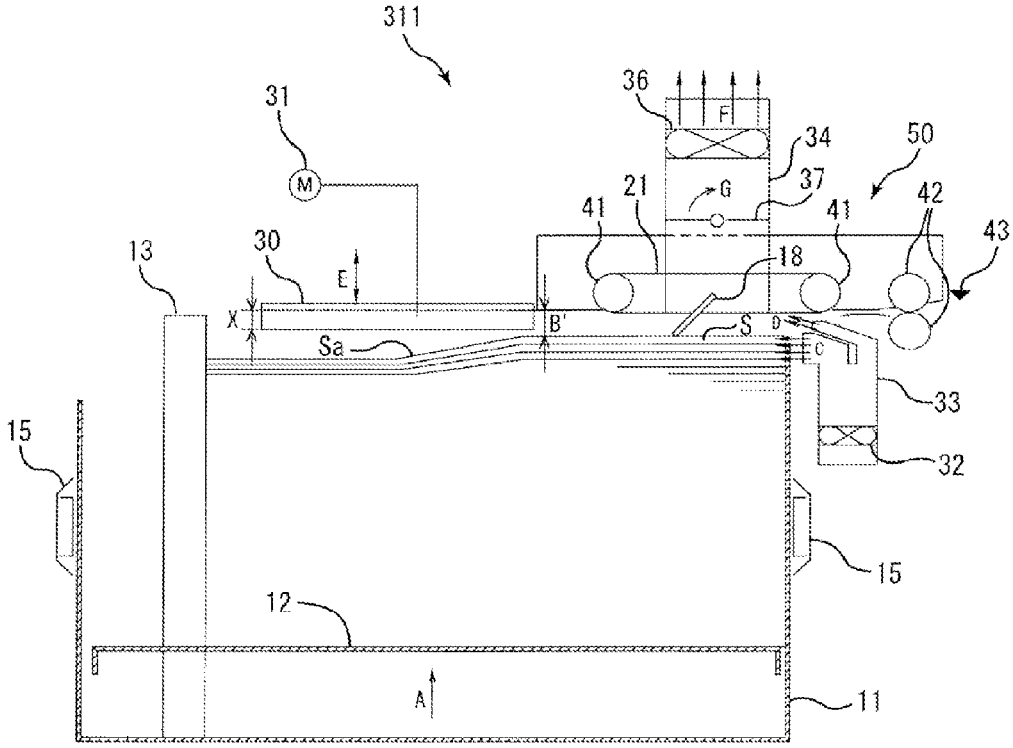
FIG. 3 is a diagram illustrating an operation of a floating preventing member which is provided in the sheet feeding apparatus.

Further, the floating preventing member 30 is provided so as to be lifted and lowered in the direction indicated by the arrow E illustrated in FIG. 2 by a preventing motor 31 rotatable forward and backward as the lifting and lowering portion, and moves to a retracting position which does not interfere with the sheet storage case 11 illustrated in FIG. 2 when the sheet storage case 11 is drawn out. Further, when the sheet storage case 11 is accommodated, the floating preventing member 30 is lowered to a predetermined height position X as illustrated in FIG. 3 by the forward rotation of the preventing motor 31. Here, the predetermined height position X as a predetermined regulating position is controlled by the reference surface as the sheet facing surface of the floating preventing member 30, and is a position where the reference surface is present between the initial sheet surface position of the uppermost sheet Sa indicated by B of FIG. 2 before the air sortation and the adsorbing surface of the adsorbing and conveying belt 21.

Figure 4:
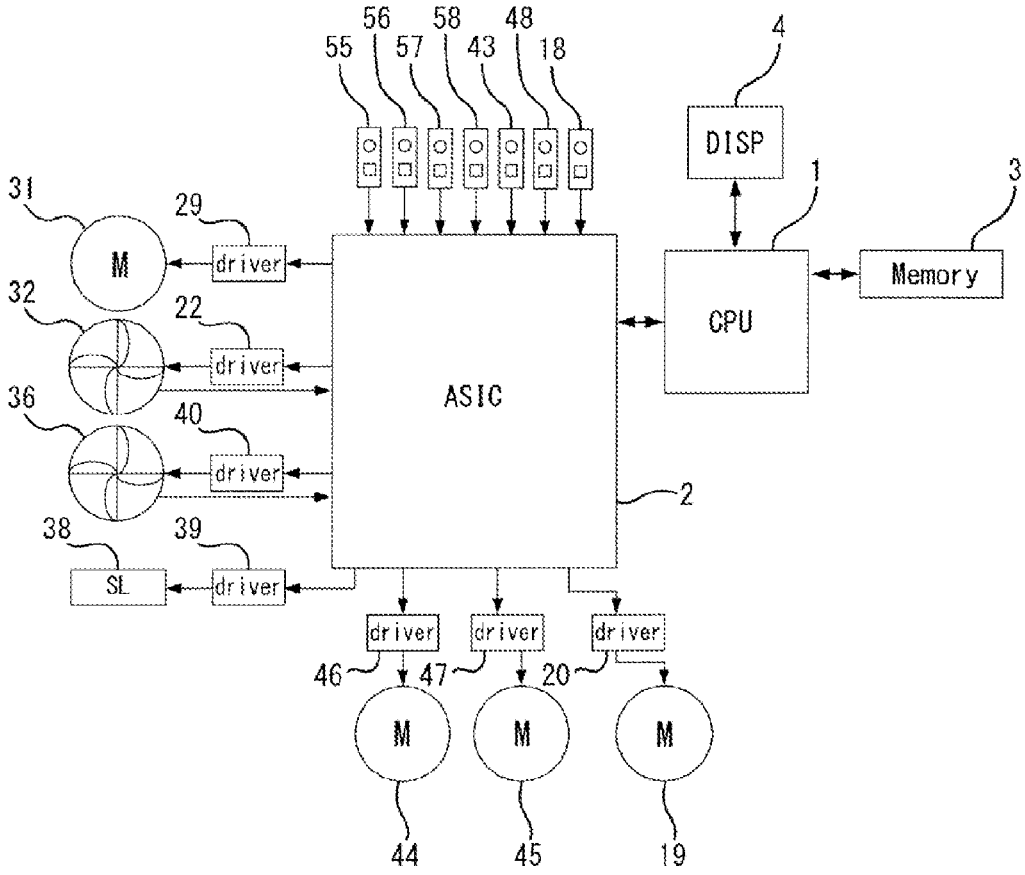
FIG. 4 is a control block diagram illustrating the sheet feeding apparatus.

FIG. 4 is a control block diagram illustrating the sheet feeding apparatus 311 according to the embodiment. In FIG. 4, the CPU 1 is a controller which controls the sheet feeding apparatus 311, and in the embodiment, the CPU 1 is provided in the apparatus body 300. The CPU 1 is connected with an exclusive ASIC 2 which drives various loads by outputting a driving start command to a driving circuit driving various loads of the sheet feeding apparatus 311 such as a motor or a fan.

Further, the CPU 1 is connected with an operation portion (DISP) 4 as a sheet information setting portion through which sheet information on the size of the sheet, the basis weight thereof, the surface property thereof, and the like may be input. Further, the CPU 1 is connected with a storage unit (memory) 3 which stores a target value or a PWM value used to adjust the fan and various data input through the operation portion 4.

Then, the CPU 1 adjusts the distance B between the adsorbing and conveying belt 21 and the uppermost sheet Sa of the sheet storage case 11 in response to the sheet information input by the user from the operation portion 4 by referring to the data stored inside the storage unit 3. Furthermore, instead of the operation portion 4, a detection portion (not illustrated) may be provided which detects at least one of the sheet size information, the basis weight information, and the surface property information as the sheet information, and the sheet information may be input to the CPU 1 from the detection portion as the input portion.

The ASIC 2 is connected with a sheet accommodating portion opening and closing sensor 48 which detects the opening and closing state of the sheet storage case 11 and lower and upper position detecting sensors 55 and 57 which detect the position of the tray 12 inside the sheet storage case 11. Further, the ASIC 2 is connected with the sheet surface detecting sensor 18 which detects the upper surface of the sheet stacked on the tray 12 and a sheet presence detecting sensor 56 which detects the presence of the sheet on the tray 12.

Further, the ASIC 2 is connected with the pass sensor 43 and an adsorbing completing sensor 58 which monitors a negative pressure state inside the suctioning duct when the sheet is adsorbed by the suctioning fan 36 and detects that the adsorption of the sheet is completed. Then, the ASIC 2 outputs a driving start command to the driving circuit driving the respective loads of the sheet feeding apparatus 311, and also performs a PWM control so that the fans rotate at the target number of rotations by receiving the rotation number signals (FG) of the sorting fan 32 and the suctioning fan 36.

Furthermore, in FIG. 4, a sorting fan driving circuit (driver) 22 transmits a PWM signal output from the ASIC 2 to the sorting fan 32 and supplies power thereto. A suctioning fan driving circuit (driver) 40 transmits a PWM signal output from the ASIC 2 to the suctioning fan 36 and supplies power thereto. A preventing motor driving circuit (driver) 29 transmits a PWM signal output from the ASIC 2 to the preventing motor 31 and supplies power thereto.

A driving circuit (driver) 39 is provided for the suctioning solenoid 38 which opens and closes the suctioning shutter 37 inside the suctioning duct 34, and a driving circuit (driver) 46 drives the feeding motor 44 which drives the belt driving roller 41. A driving circuit (driver) 47 drives a drawing motor 45 which drives the pair of drawing rollers 42.

The feeding motor 44, the drawing motor 45, and the preventing motor 31 are pulse motors, and control pulses are given from the ASIC 2 to the respective driving circuits 20, 46, and 47, so that the motor rotation amounts thereof are controlled by the number of pulses. A driving circuit (driver) 20 drives the lifter motor 19 as the tray lifting and lowering portion which lifts and lowers the tray 12. The lifter motor 19 is a DC motor, and the driving state is controlled in the on and off states.

Furthermore, in the embodiment, various loads of the sheet feeding apparatus 311 such as the motor, the fan, and the sensor are controlled through the exclusive ASIC 2 from the CPU 1, but may be directly controlled by the CPU 1. Further, in the embodiment, the operation portion 4 is provided as the setting portion through which the sheet information such as the size of the sheet, the basis weight thereof, and the surface property thereof may be input, and the storage unit 3 which stores a target value or a PWM value used for adjusting the fan and various data items input through the operation portion 4 is directly connected to the CPU 1. However, the different device of the image forming apparatus 300A, for example, the operation portion 4 may be used as the storage unit so as to input and store the sheet information.

Incidentally, when the sorting air is blown to the sheet bundle, a force is generated which presses the upper sheet toward the sheet tail end by the sorting air. At this time, in the case of the sheet having a small stiffness, as illustrated in FIG. 14, the center portion of the sheet rises, which may cause a double-feeding of the sheet.

Therefore, in the embodiment, when the sheet is fed, the CPU 1 as the controller drives the preventing motor 31 through the ASIC 2, so that the floating preventing member 30 is lowered to the predetermined height position X illustrated in FIG. 3. Accordingly, even when a sheet having a very low stiffness is fed, the floating preventing member 30 which is disposed above the tray 12 may suppress the movement of the upper sheet toward the tail end which is caused when the sheet rises upward due to the sorting air.

Figure 5:
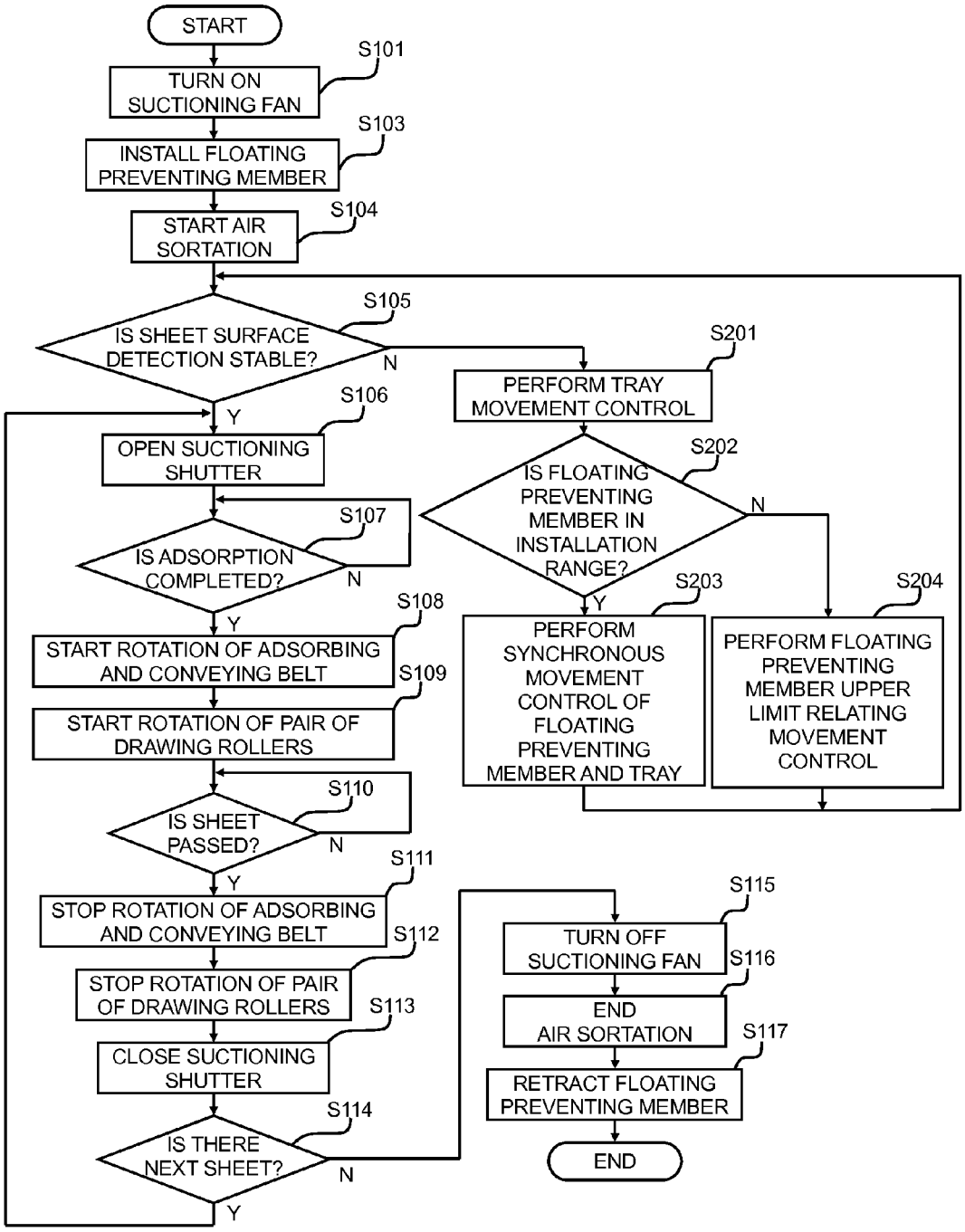
FIG. 5 is a flowchart illustrating a sheet feeding operation of the sheet feeding apparatus.

Next, the sheet conveying operation of the sheet feeding apparatus 311 with such a configuration will be described by referring to the flowchart illustrated in FIG. 5. Furthermore, the flowchart starts from a state where the tray 12 is lifted in the direction indicated by the arrow A of FIG. 2 by the lifter motor 19 and stops at a position where the distance between the adsorbing and conveying belt 21 and the uppermost sheet Sa becomes B so as to wait for a feeding signal.

When the CPU 1 receives the feeding signal in this state, the CPU 1 inputs a control signal to the suctioning fan driving circuit 40 so as to drive (turn on) the suctioning fan 36 (S101). In the same way, the CPU 1 inputs a control signal to the preventing motor driving circuit 29 so as to drive the preventing motor 31 at a predetermined number of pulses, whereby the floating preventing member 30 is dropped so as to be installed at the predetermined height position X illustrated in FIG. 3 (S103). Subsequently, the CPU 1 inputs a control signal to the sorting fan driving circuit 22 so as to drive (turn on) the sorting fan 32, whereby the air sortation starts (S104). Here, since the floating preventing member 30 is disposed at the predetermined height position at the time point at which the air sortation starts, even when the sheet is pressed toward the sheet tail end, it is possible to prevent the sheet from rising.

Subsequently, the position of the sheet surface of the uppermost sheet Sa becomes the position in which the distance between the adsorbing and conveying belt 21 and the sheet surface becomes B' illustrated in FIG. 3 by the air sortation, and the CPU 1 waits until the sheet surface detection using the sheet surface detecting sensor 18 becomes stable (S105). Here, the sheet surface detecting sensor 18 has three detection levels as described above, and when the sheet surface detection at the second level is detected, the CPU 1 determines that the sheet surface detection is stable (Y in S105). That is, the CPU determines that the sheet surface of the uppermost sheet Sa reaches an appropriate height position.

Then, the CPU 1 inputs a control signal to the suctioning solenoid driving circuit 39 so as to drive the suctioning solenoid 38 based on the determination, whereby the suctioning shutter 37 inside the suctioning duct 34 is opened (S106). Accordingly, air is suctioned from the suctioning hole provided in the adsorbing and conveying belt 21, whereby a suctioning force is generated. Then, the uppermost sheet Sa is adsorbed to the adsorbing and conveying belt 21 by the suctioning force and the separating air from the separating nozzle 33*b*.

Next, when the CPU 1 monitors the output from the adsorbing completing sensor 58 and determines that the adsorption of the uppermost sheet Sa is completed (Y in S107), the CPU 1 inputs a control signal to the feeding motor driving circuit 46 so as to drive the feeding motor 44, whereby the rotation of the adsorbing and conveying belt 21 starts (S108). In addition, the CPU 1 inputs a control signal to the drawing motor driving circuit 47 so as to drive the drawing motor 45, whereby the rotation of the pair of drawing rollers 42 starts (S109). Accordingly, the sheet is discharged onto the sheet conveying path.

Subsequently, when the CPU 1 monitors the output from the pass sensor 43 and determines that the sheet discharged onto the sheet conveying path passes by the pass sensor 43 (Y in S110), the rotation of the adsorbing and conveying belt 21 stops (S111). In addition, the CPU 1 stops the rotation of the pair of drawing rollers 42 (S112), and finally closes the suctioning shutter 37 inside the suctioning duct 34 (S113). Accordingly, the feeding of the uppermost sheet Sa ends.

Next, when there are plural sheets to be fed and the next sheet is fed, that is, the next sheet is present (Y in S114), the routine returns to S106 so as to perform the same process. When the next sheet is not present (N in S114), that is, the feeding operation ends in this state, the CPU 1 inputs a control signal to the suctioning fan driving circuit 40 so as to stop (turn off) the suctioning fan 36 (S115). In the same way, the CPU 1 inputs a control signal to the sorting fan driving circuit so as to stop the sorting fan 32, whereby the air sortation ends (S116). In addition, the CPU 1 inputs a control signal to the preventing motor driving circuit 29 so as to drive the preventing motor 31 in the reverse rotation direction at a predetermined number of pulses, whereby the floating preventing member 30 moves to the retracting position (S117) and the sheet feeding operation ends.

On the other hand, when the sheet surface detection is not stable (N in S105), that is, the sheet surface of the uppermost sheet Sa does not reach an appropriate height position, the CPU 1 performs a movement control (a height position control) on the tray 12 so that the tray 12 is lifted and lowered based on the detection result of the sheet surface detecting sensor 18 (S201). Here, when the lifter motor 19 is driven so that the tray 12 is lifted and lowered, for example, only the tray 12 is lifted, the sheet on the tray 12 collides with the floating preventing member 30. Further, when only the tray 12 is lowered, the gap between the floating preventing member 30 and the sheet on the tray 12 is widened, so that the movement of the upper sheet toward the tail end may not be suppressed.

Therefore, when the tray 12 is lifted and lowered, the driving amount equal to the driving amount of the lifter motor 19 is given to the preventing motor 31 so that the floating preventing member 30 and the tray 12 are simultaneously lifted and lowered, whereby the gap between the floating preventing member 30 and the sheet on the tray 12 is maintained to be constant. Furthermore, when the floating preventing member 30 and the tray 12 are simultaneously lifted, that is, the floating preventing member 30 is lifted so as to be synchronized with the tray 12 in this way, the floating preventing member 30 may be lifted so as to be higher than the adsorbing surface of the adsorbing and conveying belt 21 as the maximum upper limit position of the predetermined height position X.

Here, when the floating preventing member 30 is lifted in this way, the sheet on the lifted tray comes into contact with the adsorbing and conveying belt 21 so that the sheet may be deviated therefrom. For this reason, in the embodiment, it is determined whether the floating preventing member 30 is out of the range of the predetermined height position X by giving the driving amount equal to the driving amount of the lifter motor 19 to the preventing motor 31 during the movement control of the tray 12. Furthermore, as described above, the predetermined height position X indicates a position from the initial sheet surface position of the uppermost sheet Sa before the air sortation to the adsorbing surface of the adsorbing and conveying belt 21, where the sheet facing surface of the floating preventing member 30 is used as the reference surface. Then, when the position of the floating preventing member 30 which moves together with the tray 12 is present in the position range (the installation range) (Y in S202), a synchronous movement control is performed which moves the floating preventing member 30 in the same direction by the same movement amount as that of the tray 12 at the same time (S203), and the routine returns to S105.

On the other hand, when it is assumed that the position of the floating preventing member 30 which moves together with the tray 12 is present out of the installation range (N in S202), a floating preventing member upper limit relating movement control is performed (S204). That is, when it is assumed that the position of the floating preventing member 30 is present out of the installation range, the tray 12 is lifted, and the floating preventing member 30 reaches the adsorbing surface of the adsorbing and conveying belt 21 as the maximum upper limit position of the predetermined height position X. Then, the CPU 1 stops the floating preventing member 30 so as to wait at the position. Accordingly, even when the height of the sheet which is floated by the sorting air becomes higher due to the lifting of the tray 12, the sheet facing surface of the floating preventing member 30 is positioned so as to be lower than the adsorbing surface of the adsorbing and conveying belt 21, whereby the sheet S may be prevented from being caught.

Further, when the movement direction of the tray 12 is the lowering direction, the floating preventing member 30 is also lowered by the same amount in accordance with the movement amount of the lifter motor 19. Then, when the sheet height position is lowered in this way, the floating preventing member 30 is controlled so that it is lowered in accordance with the sheet height position, whereby the floating preventing member 30 is disposed so that the gap between the floating preventing member and the sheet surface is constant at all times. For this reason, it is possible to prevent the sheet from rising, and hence to reliably adsorb and convey even the thin sheets in a separated state.

As described above, in the embodiment, when the sheet is fed, the floating preventing member 30 is moved to a position higher than the height position of the uppermost sheet and lower than the adsorbing surface of the adsorbing and conveying belt 21. Then, if the floating preventing member 30 is moved in this way, even when a sheet having a very low stiffness is fed, it is possible to suppress the movement of the upper sheet toward the tail end which is generated when the sheet rises due to the sorting air by using the floating preventing member 30. Accordingly, even in a case of a sheet having a very low stiffness such as an ultrathin sheet, double-feeding of the upper sheet and the lower sheet is not performed, thereby preventing a feeding failure such as skew-feeding, curling, and an adsorbing failure from occurring in the sheet.

Figure 6:
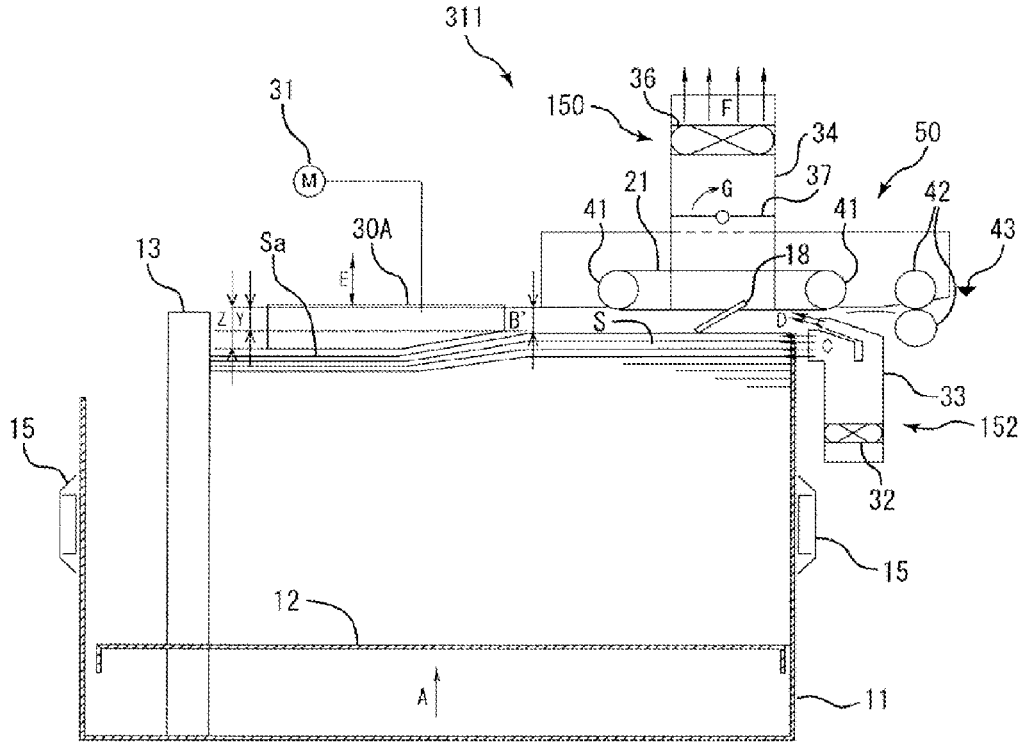
FIG. 6 is a cross-sectional view illustrating a configuration of a sheet feeding apparatus according to a second embodiment of the invention.

Next, a second embodiment of the invention will be described. FIG. 6 is a diagram illustrating a configuration of a sheet feeding apparatus according to the embodiment. Furthermore, in FIG. 6, the same reference numeral as that of FIG. 2 indicates the same or corresponding portion.

In FIG. 6, a floating preventing member 30A is provided, and the bottom surface of the floating preventing member 30A includes a surface which is parallel to the sheet upper surface and a sloped surface which is disposed on the downstream side of the sheet feeding direction so as to be inclined toward the adsorbing and conveying portion 50. Further, the floating preventing member 30A is provided so as to be lowered to a predetermined height position when the sheet storage case 11 is accommodated.

Here, the predetermined height position is set so that the height position of the downstream end of the sloped surface of the bottom surface in the sheet feeding direction becomes a predetermined height position Y which is present in the range of the distance B' between the position of the sheet surface of the uppermost sheet Sa floated by the air sortation and the adsorbing surface of the adsorbing and conveying belt 21. Further, the position of the parallel surface of the bottom surface is set to a predetermined height position Z so that the distance between the position of the sheet surface of the uppermost sheet Sa before the air sortation and the adsorbing surface of the adsorbing and conveying belt 21 is present in the range B illustrated in FIG. 2.

Then, when the floating preventing member 30A is configured in this way, even when a force is generated which presses the upper sheet toward the sheet tail end by the sorting air, it is possible to suppress the upper sheet from moving toward the sheet tail end portion by using the floating preventing member 30A. Further, as in the embodiment, it is possible to sufficiently widen the air which is blown from the sheet leading end portion toward the sheet tail end by forming the sloped surface which is inclined toward the sheet feeding portion in the bottom surface of the floating preventing member 30A. Accordingly, even in a case of an ultrathin sheet, double-feeding of the upper sheet and the lower sheet is not performed, thereby preventing a feeding failure such as skew-feeding, curling, and an adsorbing failure from occurring in the sheet.

Next, a third embodiment of the invention will be described. In the embodiment, the floating preventing member is selectively lifted and lowered in response to the basis weight of the sheet and the size of the sheet. That is, only in the case of the sheet which has a very thin thickness and a low stiffness and moves in the direction opposite to the sheet feeding direction due to the blowing air, the floating preventing member is installed at a predetermined height position.

Figure 7:
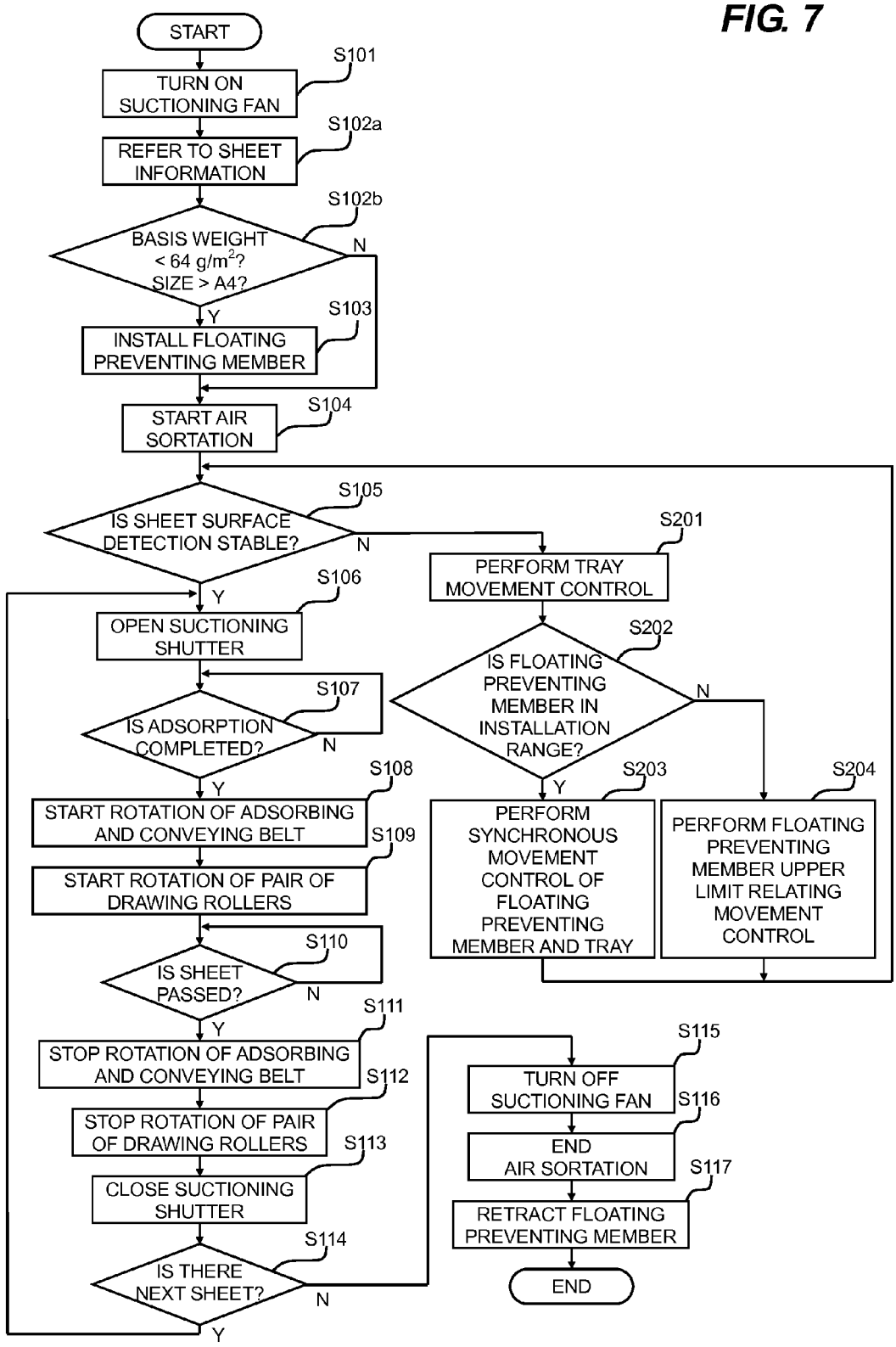
FIG. 7 is a flowchart illustrating a sheet feeding operation of a sheet feeding apparatus according to a third embodiment of the invention.

Next, the sheet feeding operation of the sheet feeding apparatus according to the embodiment will be described by referring to the flowchart illustrated in FIG. 7. Furthermore, the control starts from a state where the tray 12 is lifted in a direction indicated by the arrow A of FIG. 2 by the lifter motor 19, stops at a position where the distance between the adsorbing and conveying belt 21 and the uppermost sheet becomes B, and waits for a feeding signal.

When the CPU 1 receives the feeding signal in this state, the CPU 1 inputs a control signal to the suctioning fan driving circuit 40 so as to drive (turn on) the suctioning fan 36 (S101). Next, the CPU 1 refers to the storage unit 3 which stores the sheet information such as the size of the sheet, the basis weight thereof, and the surface property thereof input through the operation portion 4 (S102*a*). Then, the CPU 1 determines whether the basis weight of the sheet to be fed is equal to or smaller than 64 g/m$^2$ and the sheet size is larger than the size A4 based on the sheet information (S102*b*). Then, when the basis weight of the sheet to be fed is equal to or smaller than 64 g/m$^2$ and the size thereof is larger than the size A4 (Y in S102*b*), the CPU 1 installs the floating preventing member 30 at a predetermined height position (S103).

Further, when the basis weight of the sheet to be fed is equal to or smaller than 64 g/m$^2$ and the size thereof is other than the size A4 (N in S102*b*), the CPU 1 waits the floating preventing member 30 at the retracting position. Furthermore, since the following process is controlled in the same way as that of the flowchart illustrated in FIG. 5, the description thereof will not be repeated. However, in S117, the retracting operation is performed only when the floating preventing member 30 is installed in S103.

In this way, it is possible to prevent the unnecessary setting operation of the floating preventing member 30 by installing the floating preventing member 30 only for the sheet which has a size larger than the size A4, has a basis weight equal to or smaller than 64 g/m$^2$, has a very thin thickness, and a low stiffness. Furthermore, in the embodiment, the floating preventing member 30 which has the shape of the first embodiment is used, but the floating preventing member 30 which has the shape of the second embodiment may be used.

Further, instead of the operation portion 4, a detection portion (not illustrated) may be provided which detects one of the sheet size information, the basis weight information, and the surface property information as the sheet information, and the sheet information may be input to the CPU 1 from the detection portion as the input portion. Then, the CPU 1 automatically determines the size of the sheet, the basis weight thereof, and the surface property thereof based on the sheet information.

Figure 8:
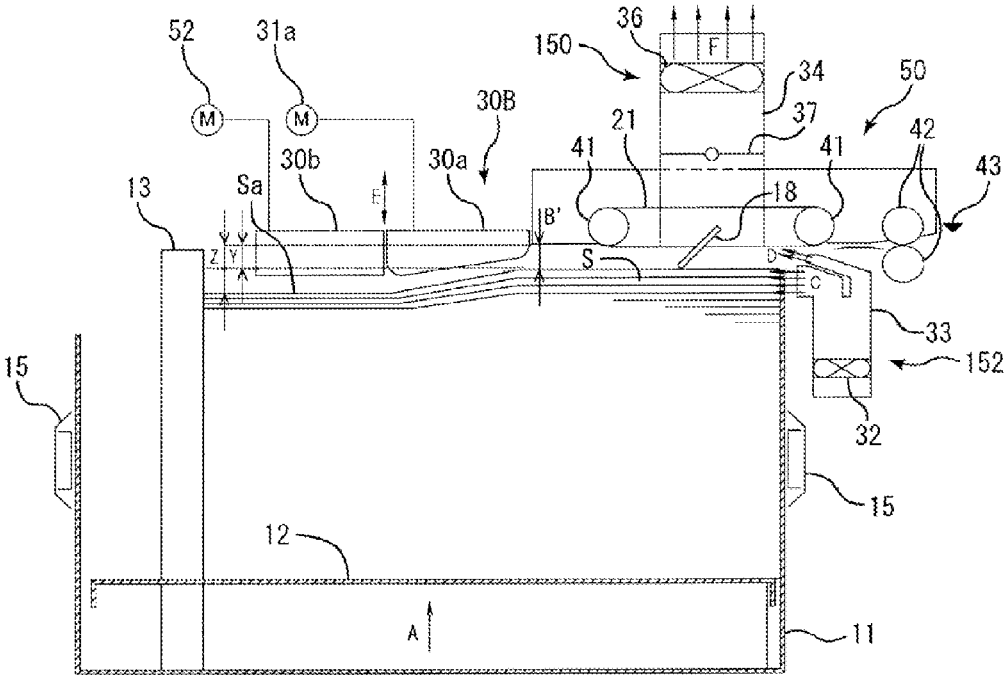
FIG. 8 is a cross-sectional view illustrating a configuration of a sheet feeding apparatus according to a fourth embodiment of the invention.

Next, a fourth embodiment of the invention will be described. FIG. 8 is a diagram illustrating a configuration of a sheet feeding apparatus according to the embodiment. Furthermore, in FIG. 8, the same reference numeral as that of FIG. 2 indicates the same or corresponding portion.

In FIG. 8, a floating preventing portion 30B is provided, and the floating preventing portion 30B includes a first floating preventing member 30*a* and a second floating preventing member 30*b* as two (plural) rising regulating members. Furthermore, the first floating preventing member 30*a* which is positioned at the downstream side in the sheet conveying direction may be selectively moved by a first preventing motor 31*a* in the direction indicated by the arrow E, and the second floating preventing member 30*b* which is positioned at the upstream side in the sheet conveying direction may be selectively moved by a second preventing motor 52 in the direction indicated by the arrow E.

Further, the bottom surface of the first floating preventing member 30*a* is inclined toward the adsorbing and conveying portion 50, and the bottom surface of the second floating preventing member 30*b* is parallel to the sheet upper surface. In addition, the first floating preventing member 30*a* is disposed above the tail end of the sheet which has a sheet size larger than A4 and smaller than A3, and the second floating preventing member 30*b* is disposed above the tail end of the sheet which has a sheet size larger than A3. Then, the first and second floating preventing members 30*a* and 30*b* respectively move to the upper retracting positions which do not interfere with the sheet storage case 11 when the sheet storage case 11 is drawn out, and are respectively lowered to the predetermined height positions Y and Z in a state where the sheet storage case 11 is accommodated.

Furthermore, the predetermined height position Y is set to a position in which the height position of the downstream end of the sloped surface of the bottom surface of the first floating preventing member 30*a* in the sheet feeding direction is in the range of the distance B' between the position of the sheet surface of the uppermost sheet Sa floated by the air sortation and the adsorbing surface of the adsorbing and conveying belt 21. Further, the predetermined height position Z is set so that the position of the parallel surface of the bottom surface of the second floating preventing member 30*b* becomes a predetermined height position in which the distance between the position of the sheet surface of the uppermost sheet Sa before the air sortation and the adsorbing surface of the adsorbing and conveying belt 21 is in the range of B illustrated in FIG. 2.

Figure 9:
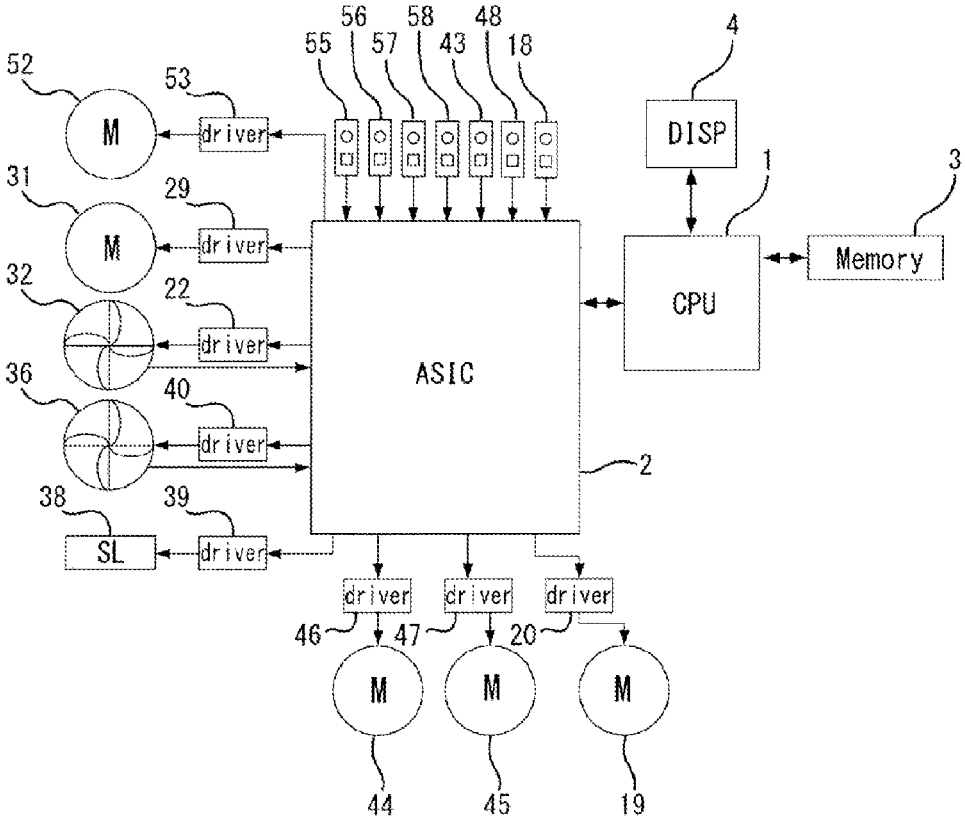
FIG. 9 is a control block diagram illustrating the sheet feeding apparatus.

FIG. 9 is a control block diagram illustrating a sheet feeding apparatus according to the embodiment. Furthermore, in FIG. 9, the same reference numeral as that of FIG. 4 indicates the same or corresponding portion. In FIG. 9, a first driving circuit 29 is provided which drives the first preventing motor 31*a* driving the first floating preventing member 30*a* so as to be moved. A second driving circuit 53 is provided which drives the second preventing motor 52 driving the second floating preventing member 30*b* so as to be moved. The first and second preventing motors 31*a* and 52 are plus motors, and a control pulse is given from the ASIC 2 to the driving circuits 29 and 53 respectively so that the rotation amount of the motor is controlled by the number of pulses.

Figure 10:
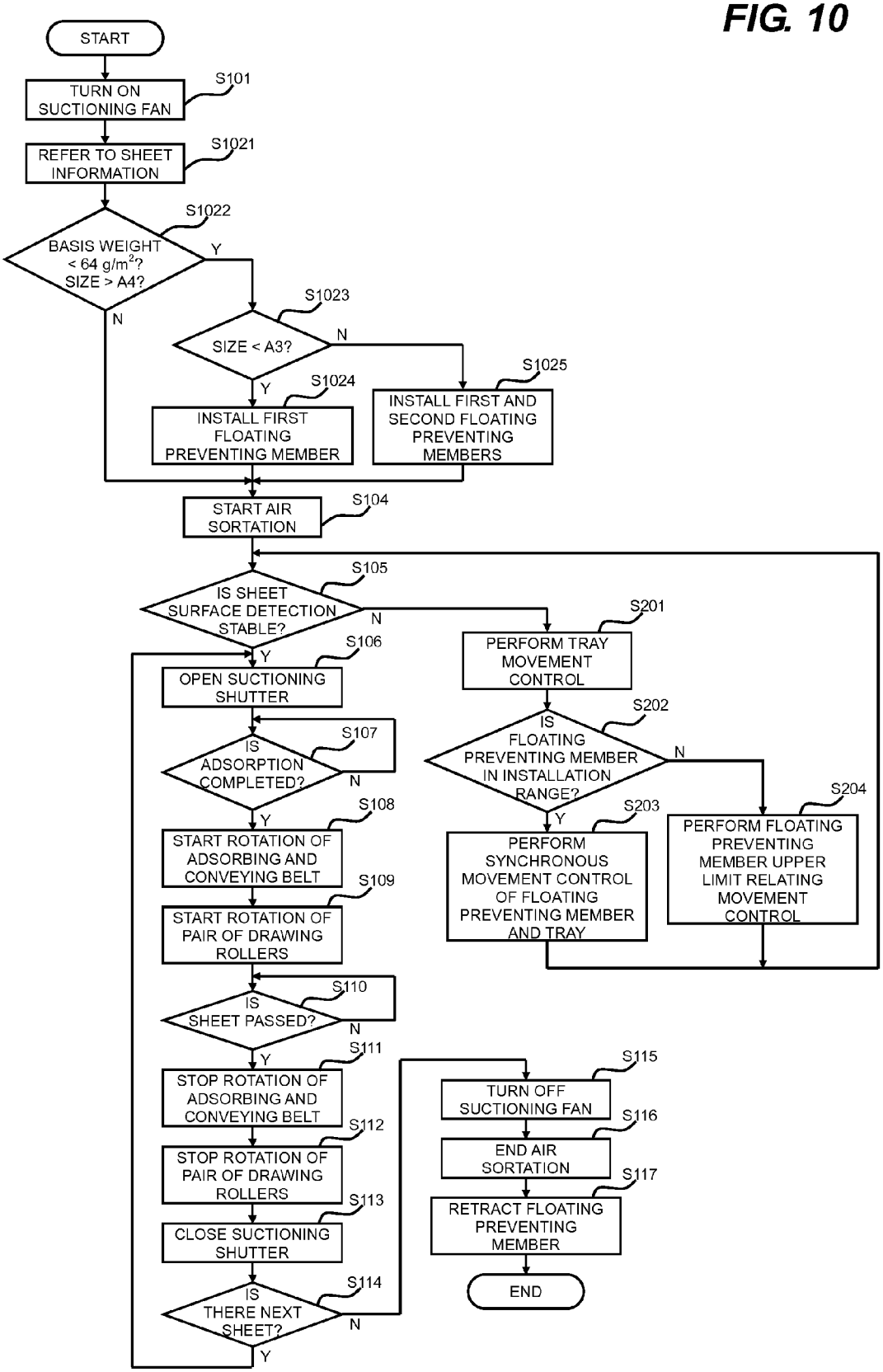
FIG. 10 is a flowchart illustrating a sheet feeding operation of the sheet feeding apparatus.

Next, the sheet feeding operation of the sheet feeding apparatus according to the embodiment will be described by referring to the flowchart illustrated in FIG. 10. Furthermore, the control starts from a state where the tray 12 is lifted in the direction indicated by the arrow A of FIG. 2 by the lifter motor 19, stops at a position where the distance between the adsorbing and conveying belt 21 and the uppermost sheet becomes B, and waits for a feeding signal.

When the CPU 1 receives the feeding signal in this state, the CPU 1 inputs a control signal to the suctioning fan driving circuit 40 so as to drive (turn on) the suctioning fan 36 (S101). Next, the CPU 1 refers to the storage unit 3 which stores the sheet information such as the size of the sheet, the basis weight thereof, and the surface property thereof input through the operation portion 4 (S1021). Then, the CPU 1 determines whether the basis weight of the sheet to be fed is equal to or smaller than 64 g/m$^2$ and the sheet size is larger than the size A4 based on the sheet information (S1022).

Here, when the basis weight of the sheet to be fed is equal to or smaller than 64 g/m$^2$ and the size thereof is larger than the size A4 (Y in S1022), the CPU 1 determines whether the size of the next sheet is equal to or larger than A3 which is larger than A4 (S1023). Then, when the size of the sheet is smaller than A3 (Y in S1023), only the first floating preventing member 30*a* is installed at a predetermined height position (S1024). Furthermore, as described above, the first floating preventing member 30*a* is disposed above the tail end of the sheet which is larger than A4 and is smaller than A3. Accordingly, when the first floating preventing member 30*a* is installed at the predetermined height position Y, it is possible to prevent the sheet which is larger than A4 and is smaller than A3 from rising upward, and hence reliably adsorb and convey even the thin sheets in a separated state.

Further, when the size of the sheet is A3 or is larger than A3 (N in S1023), the first and second floating preventing members 30*a* and 30*b* are installed at the predetermined height positions Y and Z (S1025). Here, as described above, the second floating preventing member 30*b* is disposed above the tail end of the sheet which is larger than A3. Accordingly, when the first and second floating preventing members 30*a* and 30*b* are installed at the predetermined height positions, it is possible to prevent the sheet which is larger than A3 from rising upward, and hence reliably adsorb and convey even the thin sheets in a separated state.

Further, when the basis weight of the sheet to be fed is equal to or smaller than 64 g/m$^2$ and the size thereof is other than the size A4 (N in S1022), the first and second floating preventing members 30*a* and 30*b* are waited at the retracting positions. Further, since the following process is controlled in the same way as that of the flowchart illustrated in FIG. 5, the description thereof will not be repeated. However, in S202 and S203, the floating preventing member indicates all floating preventing members which are installed in the processes of S1021 to S1025. Further, in S117, the retracting operation is performed only when at least one of the floating preventing members 30*a* and 30*b* is installed in the processes of S1021 to S1025.

In this way, according to the embodiment, the first and second floating preventing members 30*a* and 30*b* are selectively moved to a position higher than the height position of the uppermost sheet and lower than the adsorbing surface of the adsorbing and conveying belt 21 in response to the sheet size. Then, it is possible to prevent the movement of the upper sheet toward the tail end which is generated when the sheet rises upward due to the sorting air by selectively moving the first and second floating preventing members 30*a* and 30*b* in this way. Further, since the floating preventing portion 30B includes the first and second floating preventing members 30*a* and 30*b*, the motor to be used may be decreased in size and may be decreased in cost.

Incidentally, in the description so far, the sheet feeding apparatus which includes the adsorbing and conveying portion 50 adsorbing and conveying the sheet has been mentioned, but the invention is not limited thereto. That is, the invention may be also applied to a sheet feeding apparatus which sorts the sheets by blowing air to the upper portion of the sheet bundle and feeds the sheets by the feeding roller.

Figure 11:
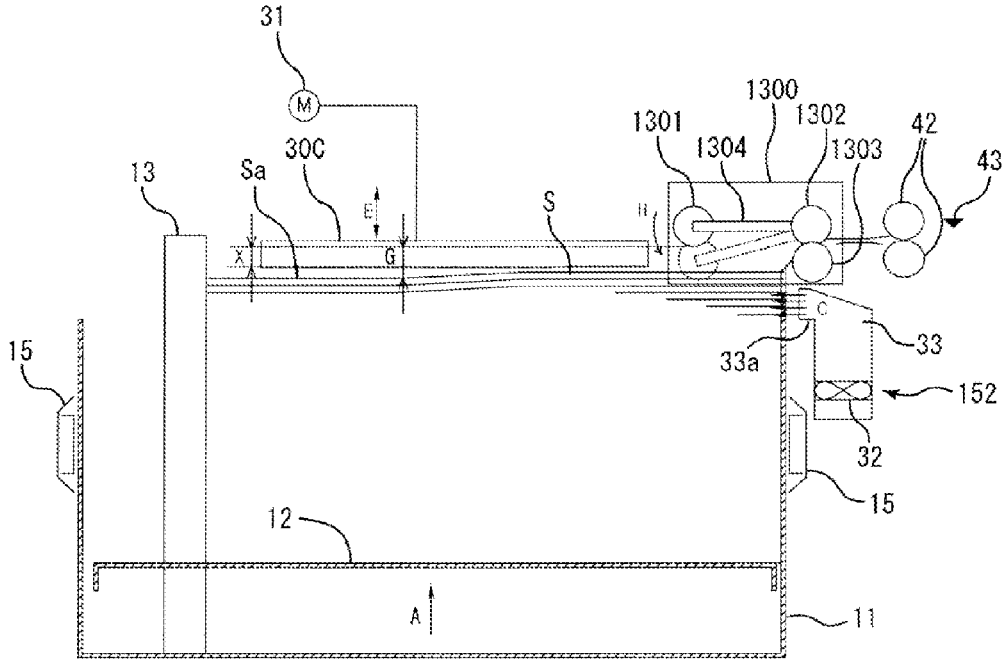
FIG. 11 is a cross-sectional view illustrating a configuration of a sheet feeding apparatus according to a fifth embodiment of the invention.

Next, a fifth embodiment of the invention will be described. FIG. 11 is a diagram illustrating a configuration of a sheet feeding apparatus in which air is blown to the upper portion of the sheet bundle according to the embodiment so as to sort the sheets and the sheets are fed by the feeding roller. Furthermore, in FIG. 11, the same reference numeral as that of FIG. 2 indicates the same or corresponding portion.

In FIG. 11, a feeding unit 1300 is provided, and the feeding unit 1300 includes a pickup roller 1301 as a feeding roller, a sheet feeding roller 1302, a separating roller 1303 pressing the sheet feeding roller 1302, and a pair of drawing rollers 42.

Here, the pickup roller 1301 is rotatably supported by a front end portion of a pickup arm 1304 which is rotatable in the direction indicated by H in the drawing, and is lowered with the downward rotation of the pickup arm 1304 during the sheet feeding operation so as to come into contact with the sheet surface. Then, the uppermost sheet Sa which is sent out by the pickup roller 1301 from the sheet storage case 11 is conveyed to a nip portion between the sheet feeding roller 1302 and the separating roller 1303, is separated from the lower sheet, and is sent to the pair of drawing rollers 42. Furthermore, the pickup arm 1304 is rotated in the vertical direction by turning on or off a pickup solenoid 1403 to be described later illustrated in FIG. 12.

Furthermore, in the embodiment, the downstream air blowing portion 152 includes the sorting nozzle 33*a* which blows air from the leading end to the upper portion of the sheet bundle, the sorting fan 32, and the separating duct 33 which sends air from the sorting fan 32 to the sorting nozzle 33*a*. Then, the air which is suctioned by the sorting fan 32 passes through the separating duct 33, and is blown in the direction indicated by the arrow C by the sorting nozzle 33*a*, so that several sheets of the upper portion of the sheets S stacked on the tray 12 are sorted.

Further, in FIG. 11, a floating preventing member 30C is provided, and the floating preventing member 30C is disposed in parallel to the sheet surface from the upstream end surface of the feeding unit 1300 in the sheet conveying direction to the downstream end surface of the tail end regulating plate 13. Further, the length of the floating preventing member 30C in the sheet main scanning direction is set to the minimum length of the sheet to be conveyed, and is set to the length corresponding to A5R in the embodiment.

In addition, the floating preventing member 30C is configured to be movable in the direction indicated by E in the drawing by the preventing motor 31. Then, the floating preventing member 30C is moved to the upper retracting position which does not interfere with the sheet storage case 11 when the sheet storage case 11 is drawn out, and is lowered so as to be installed at the predetermined height position X which does not contact the uppermost sheet Sa in a state where the sheet storage case 11 is accommodated.

Furthermore, the predetermined height position X is a position in which the position of the sheet facing surface of the floating preventing member 30C is present in a gap between the position of the sheet surface of the uppermost sheet Sa before the air sortation and the lower surface of the roller when the pickup roller 1301 indicated by the solid line and serving as the feeding and conveying surface is present at the retracting position during a non-feeding operation, where the gap is indicated by G.

Figure 12:
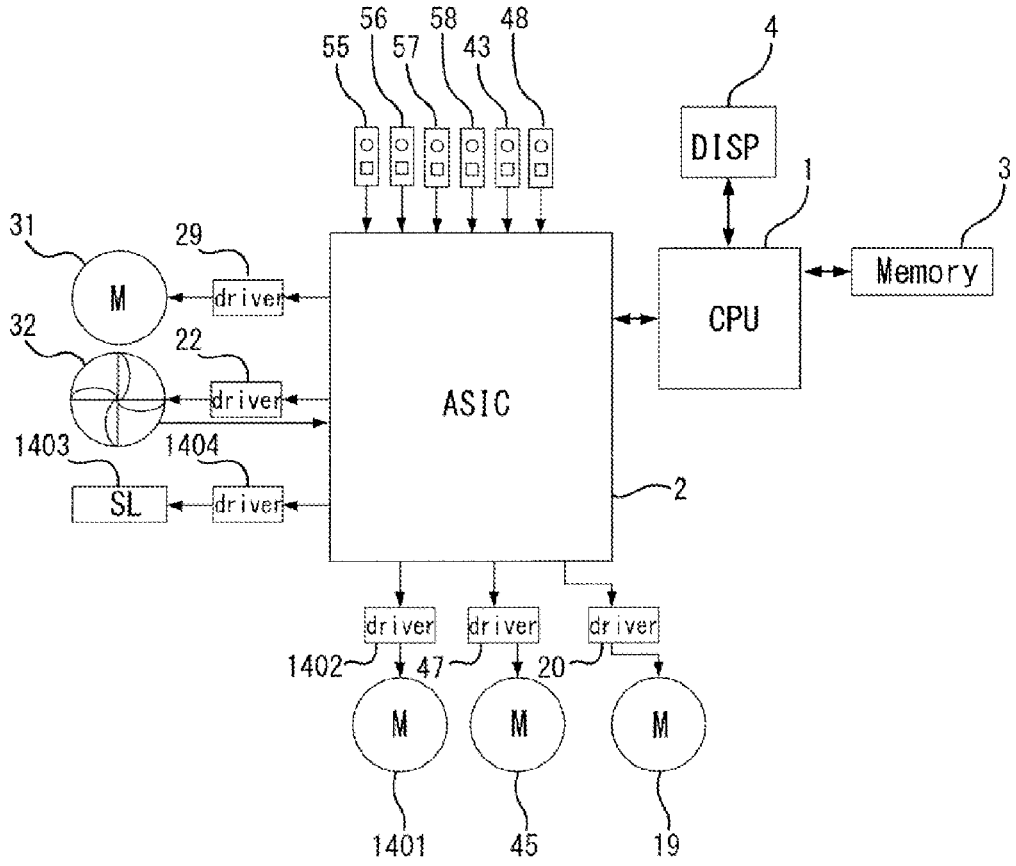
FIG. 12 is a control block diagram illustrating the sheet feeding apparatus.

FIG. 12 is a control block diagram illustrating a sheet feeding apparatus according to the embodiment. Furthermore, in FIG. 12, the same reference numeral as that of FIG. 4 indicates the same or corresponding portion. In FIG. 12, a solenoid driving circuit 1404 is provided which drives the pickup solenoid 1403 lifting and lowering the pickup roller 1301 through the pickup arm 1304. A driving circuit 1402 is provided which drives the feeding motor 1401 driving the pickup roller 1301, the sheet feeding roller 1302, and the separating roller 1303. Furthermore, the CPU 1 adjusts the distance G between the pickup roller 1301 and the uppermost sheet Sa of the sheet storage case 11 in response to the sheet information which is input by the user from the operation portion 4 by referring to the data stored in the storage unit 3.

Figure 13:
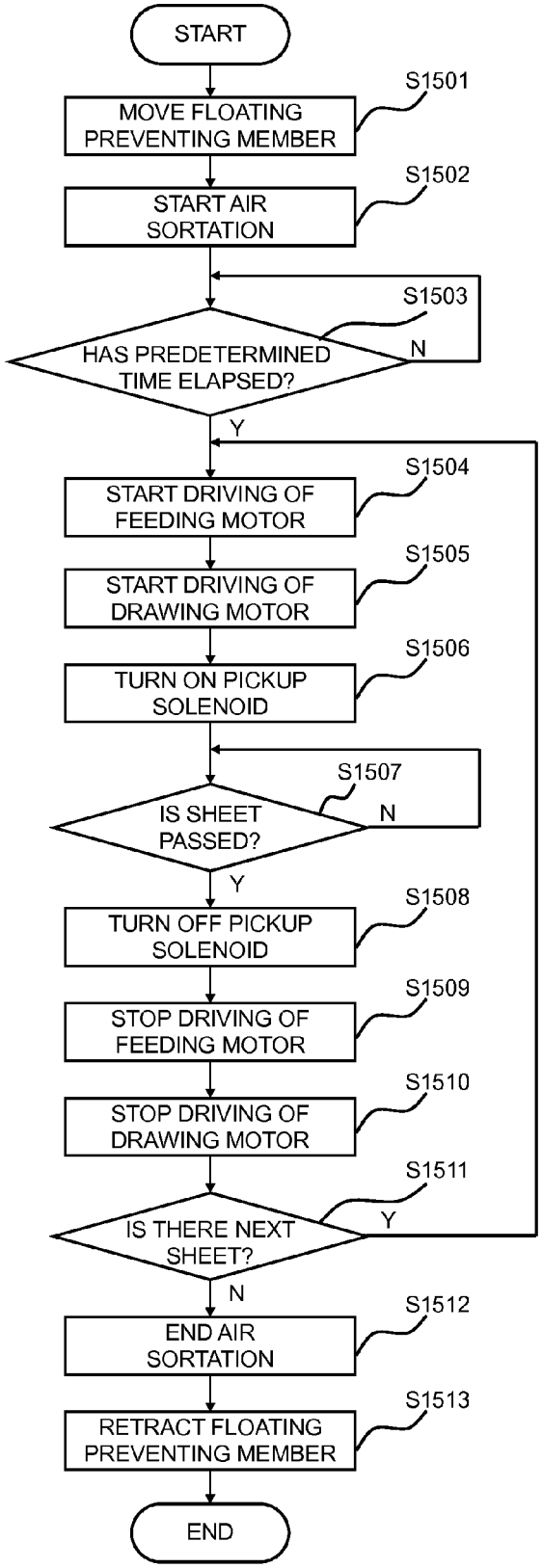
FIG. 13 is a flowchart illustrating a sheet feeding operation of the sheet feeding apparatus.

Next, the sheet feeding operation of the sheet feeding apparatus according to the embodiment will be described by referring to the flowchart illustrated in FIG. 13. Furthermore, the control starts from a state where the tray 12 is lifted in the direction indicated by the arrow A of FIG. 11 by the lifter motor 19, stops at a position where the distance between the pickup roller 1301 and the uppermost sheet Sa becomes G, and waits for a feeding signal.

When the CPU 1 receives the feeding signal in this state, the CPU 1 inputs a control signal to the preventing motor driving circuit 29 so as to drive (turn on) the preventing motor 31 at a predetermined number of pulses, whereby the floating preventing member 30C is dropped and is installed at the predetermined height position X illustrated in FIG. 11 (S1501). Subsequently, the CPU 1 inputs a control signal to the sorting fan driving circuit 22 so as to drive (turn on) the sorting fan 32, whereby the air sortation starts (S1502). Here, when the air sortation stars, since the floating preventing member 30C is disposed at the predetermined height position X, it is possible to prevent the sheet from rising due to the pressing of the sheet toward the sheet tail end. Furthermore, the air sortation is performed for a predetermined time which is determined in advance depending on the type of sheet.

Then, when a predetermined time elapses (Y in S1503), the CPU 1 inputs a control signal to the feeding motor driving circuit 1402 so as to start the driving of the feeding motor 1401 (S1504), whereby the pickup roller 1301, the sheet feeding roller 1302, and the separating roller 1303 are rotated at a predetermined speed. Next, the CPU 1 inputs a control signal to the drawing motor driving circuit 47 so as to start the driving of the drawing motor 45 (S1505), whereby the pair of drawing rollers 42 is rotated at a predetermined speed.

Next, the CPU 1 inputs a control signal to the solenoid driving circuit 1404 so as to drive (turn on) the pickup solenoid 1403 (S1506), whereby the pickup roller 1301 is brought into contact with the uppermost sheet Sa. Accordingly, the uppermost sheet Sa is fed by the pickup roller 1301, is separated from the lower sheet by the separating portion including the sheet feeding roller 1302 and the separating roller 1303, and is conveyed to the pair of drawing rollers 42 so as to be discharged to the sheet conveying path.

Subsequently, when the CPU 1 monitors the output from the pass sensor 43 and determines that the sheet discharged onto the sheet conveying path passes by the pass sensor 43 (Y in S1507), the CPU 1 turns off the pickup solenoid 1403 (S1508). Accordingly, the pickup roller 1301 is separated from the uppermost sheet Sa. Next, the CPU 1 stops the driving of the feeding motor 1401 (S1509), whereby the rotation of the pickup roller 1301, the sheet feeding roller 1302, and the separating roller 1303 stops. In addition, the CPU 1 stops the drawing motor 45 (S1510), whereby the rotation of the pair of drawing rollers 42 stops.

Next, when there are plural sheets to be fed and the next sheet is fed, that is, the next sheet is present (Y in S1511), the routine returns to S1504 so as to perform the same process. Further, when the next sheet is not present and the feeding operation directly ends in this state, the CPU 1 inputs a control signal to the sorting fan driving circuit so as to stop the sorting fan 32, whereby the air sortation ends (S1512). Further, the CPU 1 inputs a control signal to the preventing motor driving circuit 29 so as to drive the preventing motor 31 so that it rotates in the reverse rotation direction at a predetermined number of pulses, whereby the floating preventing member 30C is retracted to the retracting position (S1513). Accordingly, the sheet feeding operation ends.

As described above, even when the sheets are sorted and are fed by the pickup roller 1301, the floating preventing member 30 may suppress the movement of the sheet toward the tail end side caused by the curling of the sheet, whereby even thin sheets may be reliably fed in a separated state. That is, since the floating preventing member 30 moves so as to be disposed on the upper surface of the sheet, even the thin sheets may be reliably fed in a separated state regardless of the type of the sheet feeding structure.

Furthermore, in the respective embodiments described so far, an example has been described in which the invention is applied to the sheet feeding apparatus configured to feed the sheet to the image forming portion, but the invention is not limited thereto. For example, the invention may be applied to an inserter which supplies a sheet having an image formed thereon to a post-processing portion as a sheet processing portion or is disposed between an image forming portion and a post-processing portion so as to supply another sheet between the conveyed sheets having an image formed thereon in the image forming portion.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2011-182340, filed Aug. 24, 2011, which is hereby incorporated by reference herein in its entirety.

What is claimed is:

1. A sheet feeding apparatus comprising:

a sheet accommodating portion including a tray that supports sheets thereon, wherein the sheet accommodating portion is configured to be lifted and lowered and to be drawn out;

an air blowing portion provided downstream of the tray in a sheet feeding direction that blows air to downstream end portions of the sheets supported on the tray;

a sheet feeding portion that conveys an uppermost sheet of the sheets, supported on the tray, to which air blows;

a tail end regulating portion that comes into contact with upstream end portions of the sheets supported on the tray in the sheet feeding direction so as to regulate the positions of the sheets;

a rising regulating portion positioned above the tray between the tail end regulating portion and the sheet feeding portion, and configured so as to be able to be lifted and lowered to regulate upward rising of the uppermost sheet;

a lifting and lowering portion that lifts and lowers the rising regulating portion; and a controller that controls the lifting and lowering portion and moves the rising regulating portion to a predetermined regulating position higher than the height position of the uppermost sheet and lower than a feeding surface of the sheet feeding portion before the air blowing from the air blowing portion, wherein when the sheet accommodating portion is drawn out, the controller controls the lifting and lowering portion to move the rising regulating portion to a position where the rising regulating portion does not interfere with the sheet accommodating portion.

2. The sheet feeding apparatus according to claim 1, further comprising:

a tray lifting and lowering portion that lifts and lowers the tray; and a sheet detector that detects whether the sheet reaches a position where the sheet feeding portion is able to feed the sheet by the lifted and lowered tray, wherein the controller lifts and lowers the rising regulating portion in synchronization with the lifting and lowering of the tray by the tray lifting and lowering portion.

3. The sheet feeding apparatus according to claim 2, wherein when the rising regulating portion is lifted in synchronization with the tray, the controller stops the lifting of the rising regulating portion when the rising regulating portion reaches a predetermined regulating position so that the rising regulating portion does not exceed the predetermined regulating position.

4. The sheet feeding apparatus according to claim 1, further comprising an input portion that inputs at least sheet size information and sheet basis weight information, wherein when the controller determines that the sheets stacked on the tray are moved in the direction opposite to the sheet feeding direction due to the air blowing from the air blowing portion based on the information input from the input portion, the controller drives the lifting and lowering portion so as to move the rising regulating portion to the predetermined regulating position.

5. The sheet feeding apparatus according to claim 1, wherein a bottom surface of the rising regulating portion is provided with a sloped surface that is inclined toward the sheet feeding portion.

6. The sheet feeding apparatus according to claim 1, wherein the air blowing portion blows air to the sheets so as to float the sheets, and the sheet feeding portion adsorbs and feeds the uppermost sheet floated by the blowing air.

7. The sheet feeding apparatus according to claim 1, wherein the air blowing portion blows air to the sheets so as to sort the sheets, and the sheet feeding portion feeds the uppermost sheet sorted by the blowing air.

8. A sheet feeding apparatus comprising:

a tray that supports sheets thereon and is configured to be lifted and lowered;

an air blowing portion provided downstream of the tray in a sheet feeding direction that blows air to downstream end portions of the sheets supported on the tray;

a sheet feeding portion that conveys an uppermost sheet of the sheets, supported on the tray, to which air blows;

a tail end regulating portion that comes into contact with upstream end portions of the sheets supported on the tray in the sheet feeding direction so as to regulate the positions of the sheets;

a plurality of rising regulating members provided in the sheet feeding direction that are positioned above the tray between the tail end regulating portion and the sheet feeding portion, and configured so as to be able to be respectively lifted and lowered to regulate upward rising of the uppermost sheet;

a lifting and lowering portion that lifts and lowers the rising regulating members;

an input portion that inputs at least sheet size information and sheet basis weight information; and a controller that controls the lifting and lowering portion and moves the rising regulating portion to a predetermined regulating position higher than the height position of the uppermost sheet and lower than a feeding surface of the sheet feeding portion before the air blowing from the air blowing portion, wherein the controller controls the lifting and lowering portion to selectively move the plurality of rising regulating members to the predetermined regulating position based on the sheet size information input from the input portion.

9. The sheet feeding apparatus according to claim 8, wherein the input portion automatically determines a size, a basis weight, and a surface property of the sheet stacked on the tray.

10. An image forming apparatus comprising:

a sheet feeding apparatus including:

a sheet accommodating portion including a tray that supports sheets thereon, wherein the sheet accommodating portion is configured to be able to be lifted and lowered and to be drawn out;

an air blowing portion provided downstream of the tray in a sheet feeding direction that blows air to downstream end portions of the sheets supported on the tray;

a sheet feeding portion that conveys an uppermost sheet of the sheets, supported on the tray, to which air blows;

a tail end regulating portion that comes into contact with upstream end portions of the sheets supported on the tray in the sheet feeding direction so as to regulate the positions of the sheets;

a rising regulating portion positioned above the tray between the tail end regulating portion and the sheet feeding portion and configured so as to be able to be lifted and lowered and to regulate upward rising of the uppermost sheet;

a lifting and lowering portion that lifts and lowers the rising regulating portion;

a controller that controls the lifting and lowering portion and moves the rising regulating portion to a predetermined regulating position higher than the height position of the uppermost sheet and lower than a feeding surface of the sheet feeding portion before the air blowing from the air blowing portion; and an image forming portion that forms an image on the sheet sent from the sheet feeding apparatus, wherein when the sheet accommodating portion is drawn out, the controller controls the lifting and lowering portion to move the rising regulating portion to a position where the rising regulating portion does not interfere with the sheet accommodating portion.

11. The image forming apparatus according to claim 10, further comprising:

a tray lifting and lowering portion that lifts and lowers the tray; and a sheet detector that detects whether the sheet reaches a position where the sheet feeding portion is able to feed the sheet by the lifted and lowered tray, wherein the controller lifts and lowers the rising regulating portion in synchronization with the lifting and lowering of the tray by the tray lifting and lowering portion.

12. The image forming apparatus according to claim 11, wherein when the rising regulating portion is lifted in synchronization with the tray, the controller stops the lifting of the rising regulating portion when the rising regulating portion reaches a predetermined regulating position so that the rising regulating portion does not exceed the predetermined regulating position.

13. The image forming apparatus according to claim 10, further comprising:

an input portion that inputs at least sheet size information and sheet basis weight information, wherein when the controller determines that the sheets stacked on the tray are moved in the direction opposite to the sheet feeding direction due to the air blowing from the air blowing portion based on the information input from the input portion, the controller drives the lifting and lowering portion so as to move the rising regulating portion to the predetermined regulating position.

14. The image forming apparatus according to claim 10, wherein a bottom surface of the rising regulating portion is provided with a sloped surface that is inclined toward the sheet feeding portion.

15. The image forming apparatus according to claim 10, wherein the air blowing portion blows air to the sheets so as to float the sheets, and the sheet feeding portion adsorbs and feeds the uppermost sheet floated by the blowing air.

16. The image forming apparatus according to claim 10, wherein the air blowing portion blows air to the sheets so as to sort the sheets, and the sheet feeding portion feeds the uppermost sheet sorted by the blowing air.

17. An image forming apparatus comprising:

a tray that supports sheets thereon and is able to be lifted and lowered;

an air blowing portion provided on a downstream of the tray in a sheet feeding direction that blows air to downstream end portions of the sheets supported on the tray;

a sheet feeding portion that conveys an uppermost sheet of the sheets, supported on the tray, to which air blows;

a tail end regulating portion that comes into contact with upstream end portions of the sheets supported on the tray in the sheet feeding direction so as to regulate the positions of the sheets;

a plurality of rising regulating members provided in the sheet feeding direction that are installed above the tray so as to be able to be respectively lifted and lowered between the tail end regulating portion and the sheet feeding portion and regulates upward rising of the uppermost sheet;

a lifting and lowering portion that lifts and lowers the rising regulating portion;

an input portion that inputs at least sheet size information and sheet basis weight information, an image forming portion that forms an image on the sheet sent from the sheet feeding apparatus; and a controller that controls the lifting and lowering portion and moves the rising regulating portion to a predetermined regulating position higher than the height position of the uppermost sheet and lower than a feeding surface of the sheet feeding portion before the air blowing from the air blowing portion, wherein the controller controls the lifting and lowering portion to selectively move the plurality of rising regulating members to the predetermined regulating position based on the sheet size information input from the input portion.

18. The image forming apparatus according to claim 17, wherein the input portion automatically determines a size, a basis weight, and a surface property of the sheet stacked on the tray.

* * * * *